US006535100B2

(12) United States Patent
Forss

(10) Patent No.: US 6,535,100 B2
(45) Date of Patent: Mar. 18, 2003

(54) INSULATED TRANSFORMER FOIL WINDINGS WITH BREAKOUTS AND METHODS FOR FORMING THE SAME

(75) Inventor: Börje Anders Forss, Taby (SE)

(73) Assignee: Powerware Corporation, Raleigh, NC (US)

( * ) Notice: Subject to any disclaimer, the term of this patent is extended or adjusted under 35 U.S.C. 154(b) by 116 days.

(21) Appl. No.: 09/751,035

(22) Filed: Dec. 29, 2000

(65) Prior Publication Data

US 2002/0057177 A1 May 16, 2002

Related U.S. Application Data

(60) Provisional application No. 60/197,242, filed on Apr. 14, 2000.

(51) Int. Cl.[7] ..... H01F 27/28

(52) U.S. Cl. ..... 336/225; 336/200; 336/223; 29/602.1

(58) Field of Search ..... 336/223, 200, 336/225, 232; 29/602.1, 605, 607

(56) References Cited

U.S. PATENT DOCUMENTS

| | | | | | |
|---|---|---|---|---|---|
| 4,151,640 A | | 5/1979 | McDermott et al. | ..... | 29/605 |
| 4,222,023 A | | 9/1980 | Beech | ..... | 336/209 |
| 4,376,904 A | | 3/1983 | Horrigan | ..... | 310/208 |
| 4,395,693 A | * | 7/1983 | Marinescu | ..... | 336/223 |
| 5,274,904 A | * | 1/1994 | Proise | ..... | 336/200 |
| 5,805,045 A | * | 9/1998 | Henninger | ..... | 336/192 |
| 6,087,922 A | * | 7/2000 | Smith | ..... | 336/223 |

FOREIGN PATENT DOCUMENTS

| | | | |
|---|---|---|---|
| FR | 1 232 094 A | 10/1960 | |
| WO | WO 98 22960 A | 5/1998 | ..... H01F/41/04 |

OTHER PUBLICATIONS

International Search Report for PCT/US01/08829 dated Sep. 26, 2001.

* cited by examiner

*Primary Examiner*—Anh Mai
(74) *Attorney, Agent, or Firm*—Myers Bigel Sibley & Sajovec

(57) ABSTRACT

Winding assemblies for use in transformers include one or more foil strips and insulation covers arranged to provide electrically insulated winding and breakout portions. The winding assemblies may be constructed so as to meet creepage distance and other requirements in a margin free coil design transformer.

28 Claims, 16 Drawing Sheets

INSULATED TRANSFORMER FOIL WINDINGS WITH BREAKOUTS AND METHODS FOR FORMING THE SAME

RELATED APPLICATION

This application claims the benefit of U.S. Provisional Patent Application Ser. No. 60/197,242, filed Apr. 14, 2000, the disclosure of which is hereby incorporated herein by reference in its entirety.

FIELD OF THE INVENTION

The present invention relates to transformer windings and, more particularly, to insulated transformer windings having insulated breakouts and methods for forming the same.

BACKGROUND OF THE INVENTION

Certain safety regulations relating to insulation between transformer windings require that the transformer be designed such that a stipulated winding creepage distance is allowed without contact between respective windings and such that a stipulated clearance between respective windings is provided. The creepage distance is the shortest distance between adjacent conductors following a surface without going through insulation (rather, the distance is measured as going around and/or along insulation). Additionally, regulations may require certain minimum air distances and distances through insulation between windings. It is desirable to meet such regulations while nonetheless reducing the cost and size of the transformer.

One method that has been used to meet the foregoing regulations is to provide substantial margins as illustrated by the transformer 10 as shown in FIG. 5, which may be referred to as a "margin coil design". The transformer 10 has a core 12 with a core center leg 12A and opposed end legs 12B. The transformer 10 also includes a first, foil winding 30 that is wound about the center leg 12A, and a second, wire winding 20 that is wound about the first winding 30. Alternatively, the second winding 20 may be a foil winding also or the positions of the windings 20 and 30 may be reversed. The core 12 may include an insulating cover layer to prevent direct electrical contact with either of the windings 20, 30. Insulation layers 14, 16, 18 (which may be reinforced) are inserted between the center leg 12A and the first winding 30, between the first winding 30 and the second winding, and between the second winding 20 and the end legs 12B of the core 12.

In order to meet the above-mentioned required creepage distance and clearance (RCDC), primary margins M1 and M2 are provided above and below the winding 30 and secondary margins P1 and P2 are provided above and below the winding 20. The required margins may depend on the voltage class of the transformer, the class of the insulation employed and/or other parameters. Typically, the sum of the shortest primary and secondary margins M1, M2, P1, P2 should be greater than or equal to the RCDC. That is (regarding the core as electrically conductive), the margins and the RCDC should be related as follows:

$$M1+P1 \geqq RCDC$$

$$M2+P2 \geqq RCDC$$

$$M1+P2 \geqq RCDC$$

$$M2+P1 \geqq RCDC$$

The combined width of the winding 20 and the margins P1, P2 and the combined width of the winding 30 and the margins M1, M2 are each limited by the length L of the core center leg 12A. The widths of the margins M1, M2, P1, P2 may be substantial as compared to the widths of the windings 20, 30. Hence, a large portion of the available winding width may be consumed by the margins M1, M2, P1, P2, thereby necessitating the provision of a larger core and, accordingly, a larger transformer.

In order to provide better utilization of the available winding space, a transformer as described above may be formed without margins, i.e., with the widths of the windings being of nearly the same dimension as the length of the core center leg 12A. An exemplary margin free coil transformer 10', which may be referred to as a "margin free coil design", is shown in FIGS. 6 and 7. The transformer 10' has windings 20', 30', reinforced insulating layers 14', 16', 18', and a core 12' having a center leg 12A'. Each winding 20', 30' has a breakout on each end thereof. The breakouts 34' of the foil winding 30' are shown in cross-section in FIG. 7.

Notably, means must be provided in the margin free coil transformer 10' to address the creepage distance and clearance regulations discussed above. One method of solving this problem is to insulate the first (foil) winding 30' and its breakouts in their entireties such that the requirements for creepage distance and clearance, as well as distance through insulation, are met by the insulation about the first winding 30' alone.

For example, a winding foil strip 40 as shown in FIG. 8A may be provided. The strip 40 has a width that is approximately the same as the length of the center leg 12A'. The strip 40 is covered with an insulator 40A and then folded once to create a breakout 42 of the same width as the strip 40, as shown in FIG. 8B. However, in many transformers the width of the center leg 12A' is substantially less than its length and the breakout should be close to the width of the core. For example, in ferrite EE-cores the length to width ratio of the center leg is typically approximately two. To achieve the appropriate breakout width, the breakout 42 is folded again to form a narrow breakout 44 as shown in FIG. 8C. The breakout 44 corresponds to one of the breakouts 34' (see FIG. 7), for example. Notably, this method of folding creates substantial increases in thickness in certain areas as a result of the stacking of four layers of foil, as well as the insulation, on each layer. Additionally, the insulation may be damaged by the folding steps. If holes are formed in the insulation, the transformer may no longer meet the creepage distance, clearance and distance through insulation requirements. The existence of small holes in the insulation may be hard to detect.

According to a further prior art method, a triple insulated wire which is approved by safety agencies for use where reinforced insulation is required may be used for the winding 20' without additional insulation. The wire in the winding 20' itself provides the required insulation and there are therefore no requirements on the insulation of the winding 30' other than functional requirements. This method suffers from several drawbacks in practice.

As an alternative to using a folded foil winding, the winding 30' may be formed using an insulated winding foil strip 50 and a joined breakout 52 as shown in FIGS. 9A and 9B. The breakout 52 corresponds to one of the breakouts 34' (see FIG. 7). The breakout 52 and the strip 50 are each covered with an insulator 50A, 52A except on end portions 50B, 52B. The end portions 50B, 52B are exposed to allow electrical contact between the strip 50 and the breakout 52 over most of the width of the strip 50. According to some prior art methods, one or more supplemental insulation members may be provided covering the exposed portions of the winding foil strip and the breakout. However, such constructions may not in fact provide a true margin free coil design while still meeting applicable safety requirements and, accordingly, margins are still required.

SUMMARY OF THE INVENTION

The invention is directed to winding assemblies for use in transformers and methods for forming the same. The winding assemblies include one or more foil strips and insulation covers arranged to provide electrically insulated winding and breakout or breakout tap portions. The winding assemblies may be constructed so as to meet the aforementioned creepage distance and other requirements.

According to method embodiments of the invention for forming an insulated winding assembly for an electrical transformer, an integral foil strip having a lengthwise axis is provided. The foil strip includes a winding portion and a breakout portion extending from the winding portion along the lengthwise axis. The breakout portion is folded about the winding portion to form a fold between the breakout portion and the winding portion. Thereafter, an insulation cover is secured to the foil strip.

The step of securing an insulation cover to the foil strip may include securing a first insulation cover to the winding portion and securing a second insulation cover to the breakout portion such that a contact portion of the foil strip adjacent the fold remains exposed. The method further includes securing a supplemental insulation cover over the contact portion. The second insulation cover may be overlapped over the winding portion by at least a prescribed minimum creepage distance.

According to further method embodiments of the invention for forming an insulated winding assembly for an electrical transformer, a foil winding strip having a lengthwise axis and a first insulation cover covering a portion of the winding strip are provided. An exposed portion of the winding strip extends beyond the first insulation cover along the lengthwise axis of the winding strip. A foil breakout strip having a lengthwise axis and a second insulation cover covering a portion of the breakout strip is also provided. An exposed portion of the breakout strip extends beyond the second insulation cover along the lengthwise axis of the breakout strip. The breakout strip is placed on the winding strip such that the breakout strip exposed portion engages the winding strip exposed portion and the second insulation cover overlaps the winding strip.

The second insulation cover may overlap the winding strip by at least a prescribed minimum creepage distance. A supplemental insulation cover may be secured over the breakout strip exposed portion.

According to other method embodiments of the invention for forming an insulated winding assembly for an electrical transformer, a foil winding portion and a foil breakout portion adjoining the winding portion are provided. The breakout portion overlaps and extends at an angle with respect to the winding portion. A supplemental insulation cover is wrapped about and between the winding portion and the breakout portion such that the supplemental insulation cover includes a first panel covering the breakout portion, a second panel covering a rear surface of the winding portion, and a third panel disposed between the winding portion and the breakout portion.

According to other method embodiments of the invention for forming an insulated winding assembly for an electrical transformer, a foil winding strip and a foil breakout strip are provided. The foil winding strip has a lengthwise axis and a first insulation cover covering a portion of the winding strip. An exposed portion of the winding strip extends beyond the first insulation cover along the lengthwise axis of the winding strip. The foil breakout strip has a lengthwise axis and a second insulation cover covering a portion of the breakout strip. An exposed portion of the breakout strip extends beyond the second insulation cover along the lengthwise axis of the breakout strip. The breakout strip is placed on the winding strip such that the breakout strip exposed portion engages the winding strip exposed portion and the breakout strip and the winding strip form an inner corner therebetween. A bellows cover is placed over the breakout strip and the winding strip such that a first leg portion of the bellows cover overlaps the first insulation cover, a second leg portion of the bellows cover overlaps the second insulation cover, and a bellows section of the bellows cover extends across the inner corner and joins the first and second leg portions. The method may further include placing an L-shaped cover over the breakout strip and the winding strip such that the L-shaped cover overlaps each of the first and second insulation covers and the first and second leg portions.

According to further embodiments of the invention, a winding assembly for use in a transformer includes a foil strip. The foil strip includes a winding portion and a breakout portion integral with the winding portion and joined to the winding portion along a fold. A first insulation cover covers a portion of the winding portion. A second insulation cover covers a portion of the breakout portion. A supplemental insulation cover covers each of the winding portion and the breakout portion.

According to further embodiments of the invention, a winding assembly for use in a transformer includes a foil winding strip having a lengthwise axis and a first insulation cover covering a portion of the winding strip. An exposed portion of the winding strip extends beyond the first insulation cover along the lengthwise axis of the winding strip. The winding assembly further includes a foil breakout strip having a lengthwise axis. A second insulation cover covers a portion of the breakout strip. An exposed portion of the breakout strip extends beyond the second insulation cover along the lengthwise axis of the breakout strip. The breakout strip exposed portion engages the winding strip exposed portion and the second insulation cover overlaps the winding strip.

According to embodiments of the invention, a winding assembly for use in an electrical transformer includes a foil winding portion and a foil breakout portion adjoining the winding portion. The breakout portion overlaps and extends at an angle with respect to the winding portion. A supplemental insulation cover is wrapped about and between the winding portion and the breakout portion. The supplemental insulation cover includes a first panel covering the breakout portion, a second panel covering a rear surface of the winding portion, and a third panel disposed between the winding portion and the breakout portion.

According to further embodiments of the invention, a winding assembly for use in a transformer includes a foil winding strip and a foil breakout strip. The foil winding strip has a lengthwise axis. A first insulation cover covers a portion of the winding strip. An exposed portion of the winding strip extends beyond the first insulation cover along the lengthwise axis of the winding strip. The foil breakout strip has a lengthwise axis. A second insulation cover covers a portion of the breakout strip. An exposed portion of the breakout strip extends beyond the second insulation cover along the lengthwise axis of the breakout strip. The breakout strip exposed portion engages the winding strip exposed portion and the breakout strip and the winding strip form an inner corner therebetween. A bellows cover covers the breakout strip and the winding strip. The bellows cover includes a first leg portion overlapping the first insulation cover, a second leg portion overlapping the second insulation cover, and a bellows section extending across the inner corner and joining the first and second leg portions. The winding assembly may further include an L-shaped cover covering the breakout strip and the winding strip, the L-shaped cover overlapping each of the first and second insulation covers and the first and second leg portions.

Objects of the invention will be appreciated by those of ordinary skill in the art from a reading of the Figures and the detailed description of the preferred embodiments which follow, such description being merely illustrative of the invention.

DETAILED DESCRIPTION OF THE PREFERRED EMBODIMENTS

The invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout. The thicknesses of layers and relative dimensions of panels, folds and spaces as illustrated in the Figures may be exaggerated for clarity.

Figure 6:
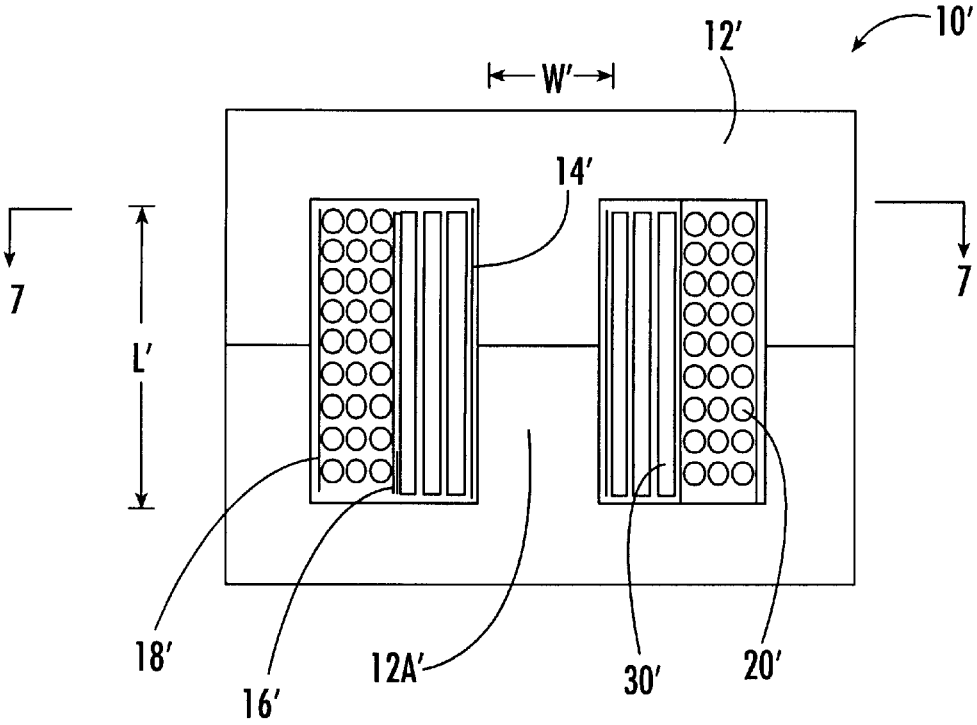
FIG. 6 is a schematic, cross-sectional view of a margin free coil design transformer.
Figure 7:
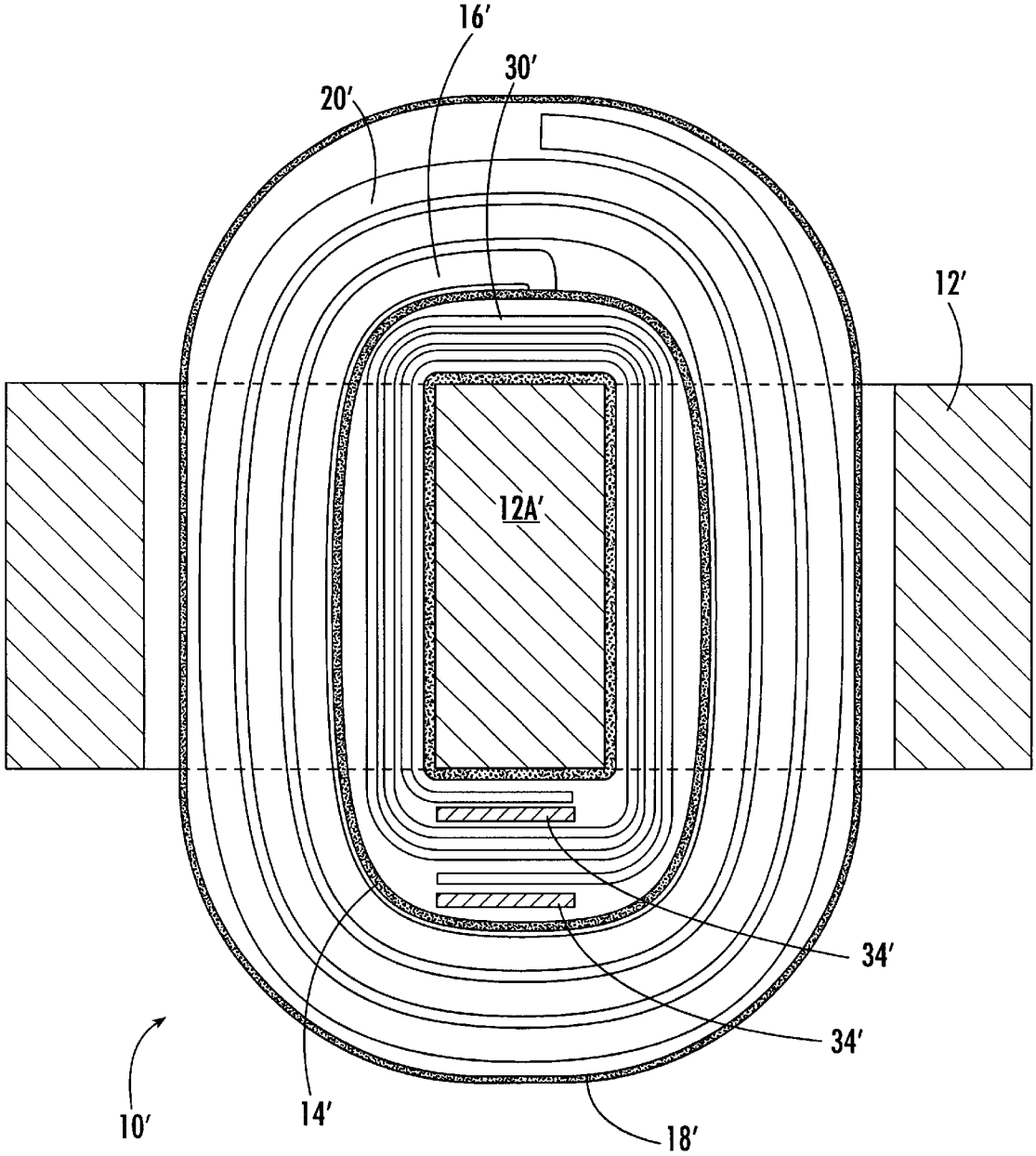
FIG. 7 is a schematic, cross-sectional view of the transformer of FIG. 6 taken along the line 7—7 of FIG. 6.
Figure 8A:
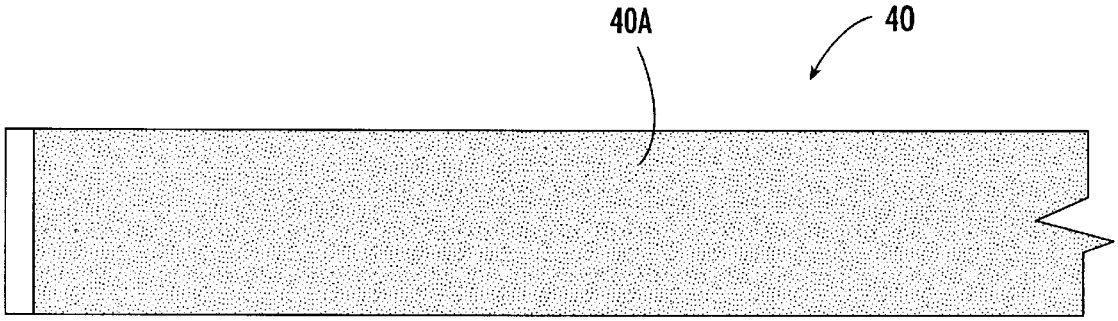
FIG. 8A is a front view of an insulated foil strip for forming a winding assembly according to the prior art.
Figure 8B:
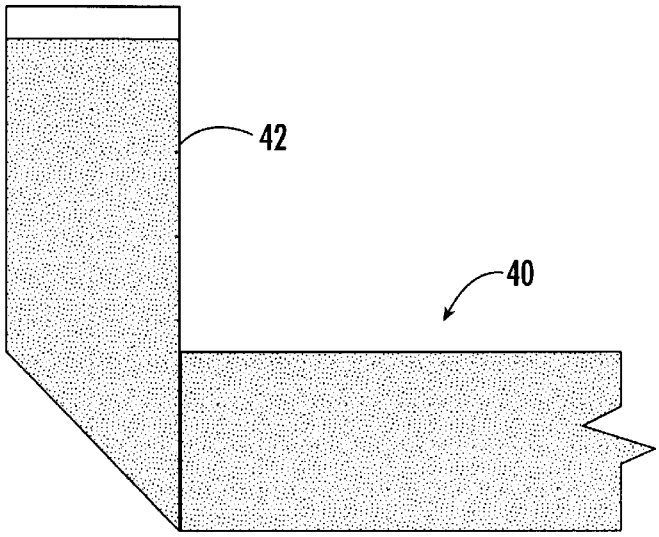
FIG. 8B is a front view of the winding strip of FIG. 8A in a first folded position.
Figure 8C:
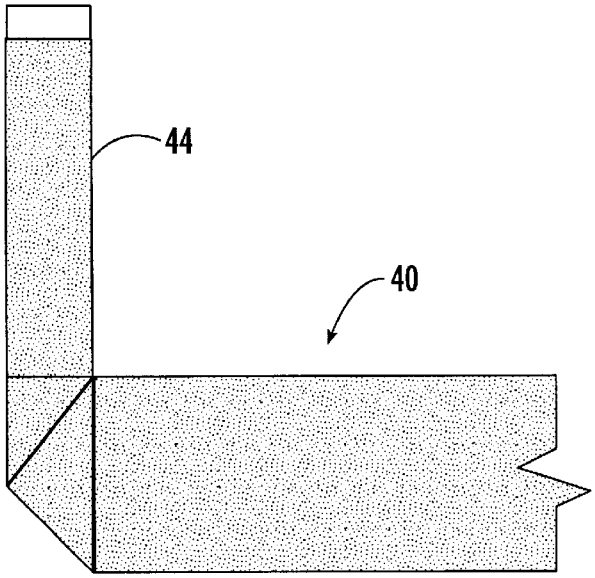
FIG. 8C is a front view of an insulated winding assembly according to the prior art having a folded breakout.
Figure 9A:
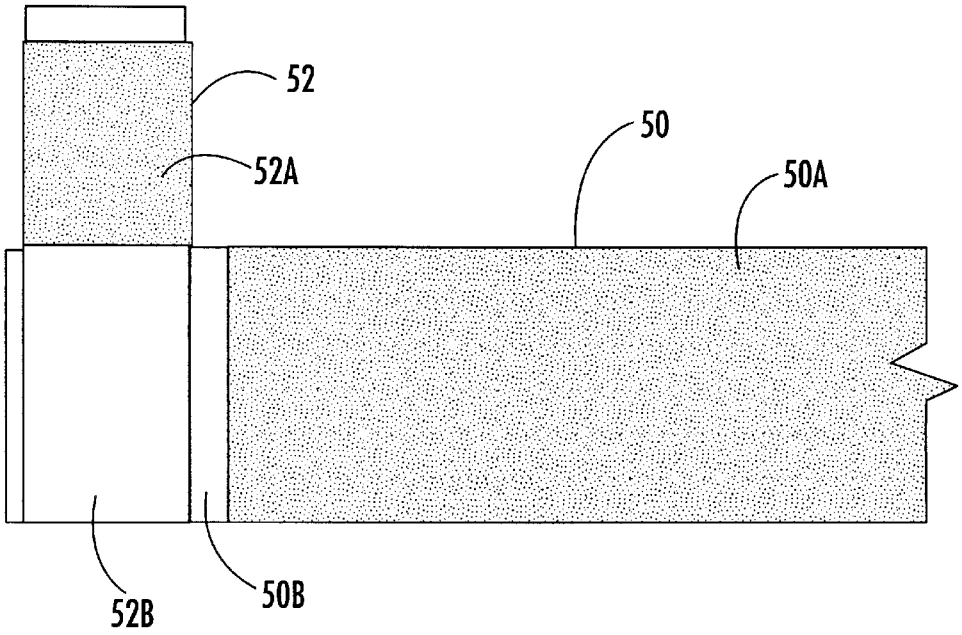
FIG. 9A is a front view of an insulated winding assembly according to the prior art having a joined breakout.
Figure 9B:
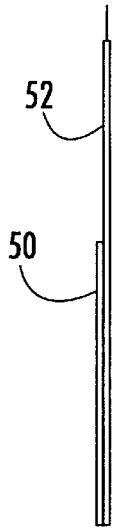
FIG. 9B is a left end view of the winding assembly of FIG. 9A.

With reference to FIGS. 1A–1D, an insulated foil winding assembly 190 as shown therein may be employed in a transformer as described above or any other suitable transformer to provide a reduced margin or a margin free coil design transformer as shown in FIGS. 6 and 7. As used herein, "margin free coil design" refers to transformers having only nominal spacing between the edges of the windings and the core. The invention may be employed to allow reduced margins that may not be commonly referred to as margin free, as well.

For the purpose of explanation, the winding assembly 190 is described with reference to the transformer 10'. As will be appreciated from the description herein, the winding assembly 190 may be substituted for the winding 30' of the transformer 10'. The transformer incorporating the winding assembly 190 may be otherwise formed and constructed in conventional or other suitable manner. The winding assembly 190 and other winding assemblies according to the present invention may be incorporated into transformers of other types and designs.

The winding assembly 190 includes a winding portion 192 and a folded breakout 194 which may be suitably sized, configured and insulated to meet the aforedescribed creepage distance, clearance and distance through insulation requirements. For most applications, the winding assembly 190 will also have a second breakout on the end of the winding portion 192 opposite the breakout 194. The second breakout is preferably a mirror image or an inverted mirror image of the breakout 194. The construction of the winding assembly 190 may be better appreciated with reference to FIGS. 1A–1I and the description of the preferred method for forming the winding assembly 190 that follows.

Figure 1H:
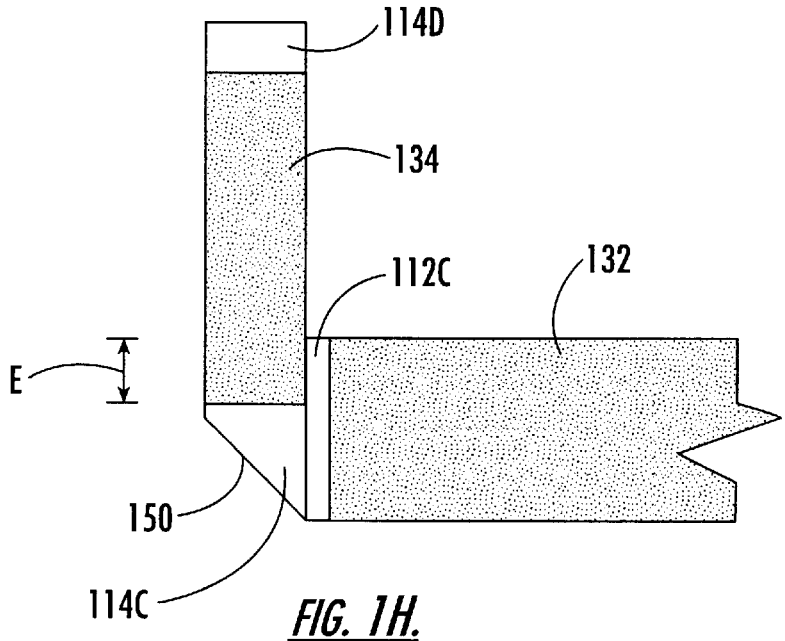
FIG. 1H is a front view of the foil strip of FIG. 1F in the folded position, and further including insulation covers.
Figure 1A:
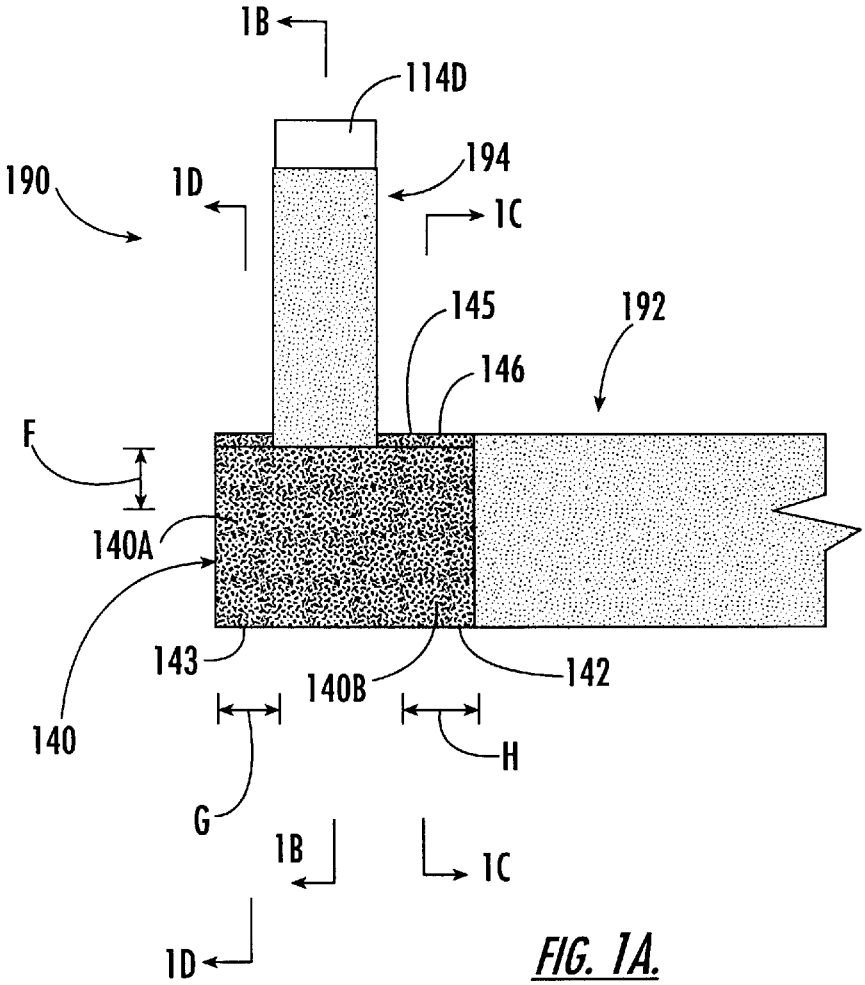
FIG. 1A is a front view of a winding assembly according to the present invention.
Figure 1D:
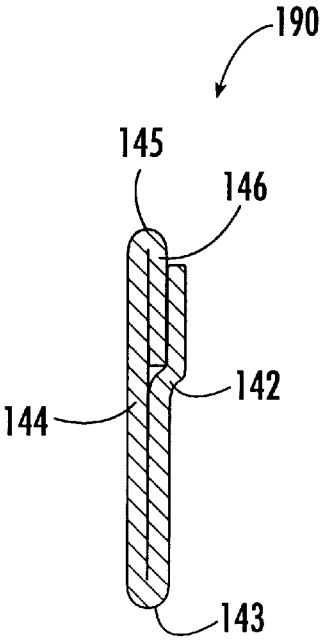
FIG. 1D is a cross-sectional view of the winding assembly of FIG. 1A taken along the line 1D—1D of FIG. 1A.
Figure 1C:
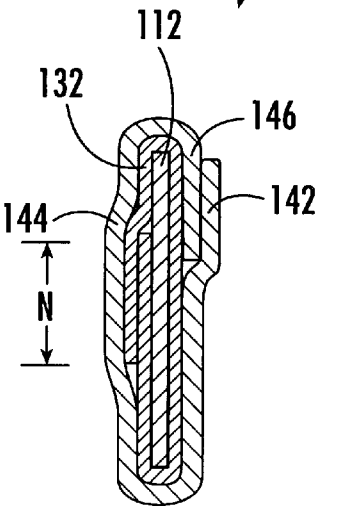
FIG. 1C is a cross-sectional view of the winding assembly of FIG. 1A taken along the line 1C—1C of FIG. 1A.
Figure 1B:
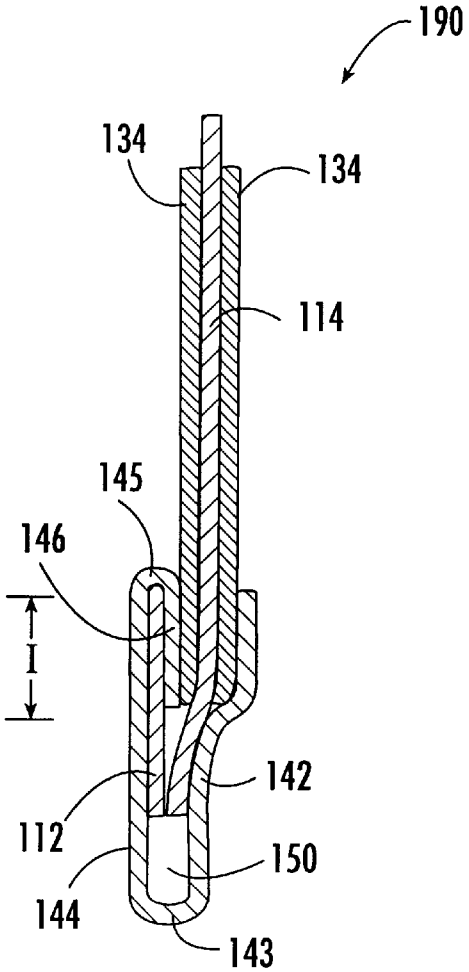
FIG. 1B is a cross-sectional view of the winding assembly of FIG. 1A taken along the line 1B—1B of FIG. 1A.
Figure 1I:
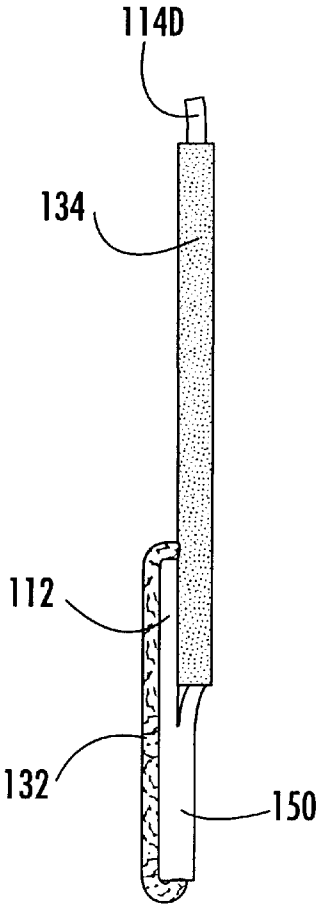
FIG. 1I is a left end view of the foil strip and insulation covers of FIG. 1H.
Figure 1E:
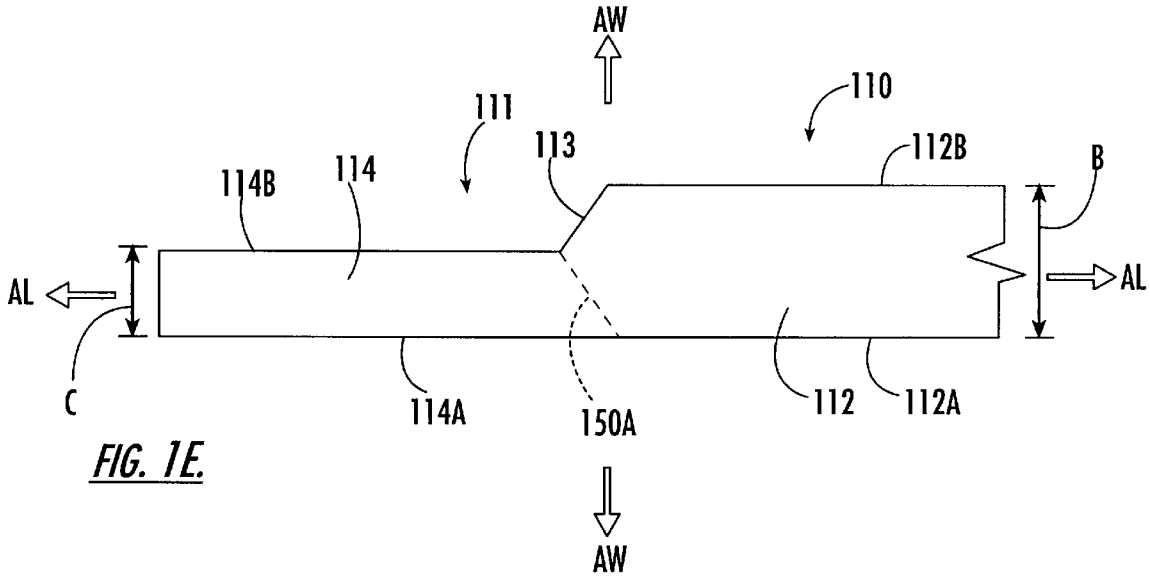
FIG. 1E is a front view of a foil strip for forming the winding assembly of FIG. 1A.

With reference to FIG. 1E, the winding assembly 190 may be formed using a foil strip 110 having a lengthwise axis AL—AL and a widthwise axis AW—AW extending substantially perpendicular to the lengthwise axis AL—AL. The foil strip 110 is preferably formed of a unitary foil of flexible, electrically conductive material. More preferably, the foil strip 110 is formed of a foil of copper. Preferably, the foil strip 110 has a substantially uniform thickness. The thickness and other dimensions of the foil will vary with the design and rating of the transformer. Preferably, the foil has a width to thickness ratio of at least 1, and more preferably of between about 10 and 500. The invention is particularly advantageous for foils having a thickness of between about 0.1 and 1.0 mm. The length of the foil strip 110 will depend on the desired lengths of the breakout 194, the second, opposite breakout, and the winding portion 192. The foil strip 110 may be cut from a larger piece of foil and/or a portion of the original foil strip may be cut away to provide the illustrated shape. For example, a cut-out 111 as discussed below may be formed by cutting and removing a portion of the foil strip.

The foil strip 110 includes a winding portion 112 having a width B which is preferably slightly less than the length L' of the core center leg 12A' of the associated transformer 10'. More preferably, the width B is between about 0.5 and 2 mm less than the length L' of the core center leg 12A'.

The foil strip 110 also includes a breakout portion 114 having a reduced width C as compared to the width B of the winding portion 112. Preferably, the width C is the same as or less than the width W' of the core center leg 12A'.

The winding portion 112 and the breakout portion 114 have substantially collinear lower edges 112A and 114A extending parallel to the axis AL—AL. The upper edges 112B and 114B of the winding portion 112 and the breakout portion 114 also extend parallel to the axis AL—AL, but are laterally spaced apart from one another along the transverse axis AW—AW. A sloped edge 113 joins the edges 112B and 114B and, along with the edge 114B, defines a cut-out 111 in the winding strip 110. Preferably, the edge 113 forms an angle of between about 45 and 90 degrees with the edge 114B.

Figure 1F:
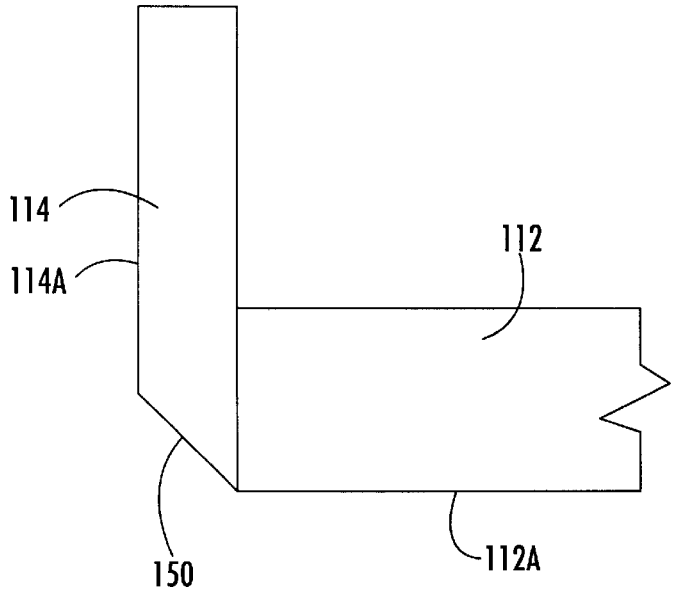
FIG. 1F is a front view of the foil strip of FIG. 1E in a folded position.
Figure 1G:
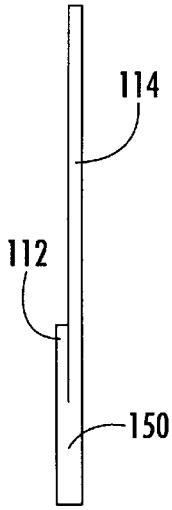
FIG. 1G is a left end view of the foil strip of FIG. 1F in the folded position.

The foil strip 110, while still uninsulated, is folded about a fold line 150A (indicated in dashed lines in FIG. 1C) to form a fold 150 as shown in FIG. 1F. Preferably, the fold 150 forms an angle of about 45 degrees with respect to the axis AL—AL. In this manner, the breakout portion 114 is re-positioned such that the length thereof extends substantially parallel to the axis AW—AW and substantially perpendicular to the axis AL—AL.

Because the foil strip 110 is not insulated, the fold 150 can be flattened using force without damaging insulation. Preferably, any burrs and/or any other defects are removed before applying insulation as described below.

After the foil strip 110 is folded and finished as described above, insulation covers 132 and 134 are applied over the foil strip 110 such that portions of the winding portion 112 and the breakout portion 114 are covered on their front and rear sides and on their lengthwise edges as shown in FIGS. 1H and 1I. The insulation cover 134 overlaps the portion 112C a distance E. The insulation covers 132, 134 are preferably provided in the form of a coherent web and are wrapped about the foil strip 110. Preferably, the insulation cover 132 overlaps itself on the rear surface of the winding portion 112 a distance N (see FIG. 1C). The insulation covers 132, 134 may be held in place by glass fiber tape or backing adhesive, for example. The insulation covers 132, 134 are electrically insulative. Preferably, the insulation covers 132, 134 are flame resistant and relatively thermally conductive. Suitable insulation cover materials include Nomex™ insulation paper available from DuPont Corporation.

Adjacent portions 112C and 114C of the winding portion 112 and the breakout portion 114, respectively, remain exposed and uncovered by the insulation covers 132, 134. A supplemental insulation cover 140 is folded about the foil strip 110 as shown in FIGS. 1A–1D to fully cover and insulate the previously exposed portions 112C, 114C. The cover 140 includes a first panel 142 covering the forwardly facing surfaces of the winding portion 112 and the breakout portion 114, a second panel 144 joined to the first panel 142 along a fold 143 and covering the rearwardly facing surfaces of the portions 112, 114, and a third panel 146 joined to the second panel 144 along a fold 145. The third panel 146 is inserted between the forwardly facing surface of the winding portion 112 and the rearwardly facing surface of the breakout portion 114. Left and right marginal portions 140A and 140B of the insulation cover 140 are disposed on opposed sides of the breakout 194. Preferably, the insulation cover 140 is formed of the same type of material as described above for the insulation covers 132, 134 and may be applied and secured in the same manner.

The insulation cover 134 overlaps the portion 112C a distance E. The panel 142 overlaps the insulation cover 134 a distance F. Each of the panels 142, 144, 146 has a right marginal portion that overlaps the insulation cover 132 a distance H and a left marginal portion that extends leftwardly beyond the fold 150 a distance G. The panel 146 overlaps the winding portion 112 a distance I.

In this manner, the entirety of the foil strip 110 except a breakout contact portion 114D (and any other intended breakout contact portions) is covered by and enveloped within the insulation covers 132, 134, 140. By appropriate selection of the dimensions of the insulation covers 132, 134, 140, the creepage distance, clearance and distance through insulation requirements may be met. Preferably, each of the following distances (allowing for manufacturing tolerances) are equal to or greater than the required or desired creepage distance and clearance:

(1) distance E (FIG. H)—from the upper edge 112B of the winding portion 112 down to the lower edge of the insulation cover 134;

(2) distance F (FIG. 1A)—from the upper edge of the insulation panel 142 to the lower edge of the insulation cover 134;

(3) distance G (FIG. 1A)—from the left edge of the breakout portion 114 to the left edges of the panels 142, 144 and 146;

(4) distance H (FIG. 1A)—from the left edges of the insulation cover 132 to the right edges of the panels 142, 144 and 146; and (5) distance I (FIG. 1B)—from the upper edge 112B of the winding portion 112 to the lower edge of the panel 146.

The winding portion 192 of the winding assembly 190 may be wound about the center leg 12A' with the breakout(s) 194 extending along an axis parallel to the axis of the center leg 12A'. Because the insulation covers 132, 134, 140 securely and completely envelope the critical portions of the foil strip 110, the core 12' and the center leg 12A' may be sized and configured to provide a margin free (or reduced margin) coil design. The method by which the winding assembly 190 is formed substantially reduces the risk that any of the insulation covers 132, 134, 140 may be damaged or breached during construction of the winding assembly 190, and also allows the winding assembly 190 to be formed without undue thickness.

Because the foil strip 110 is not insulated, the fold 150 can be flattened using force without damaging insulation. Therefore, the method may be used effectively on thick and hard foils.

Figure 2F:
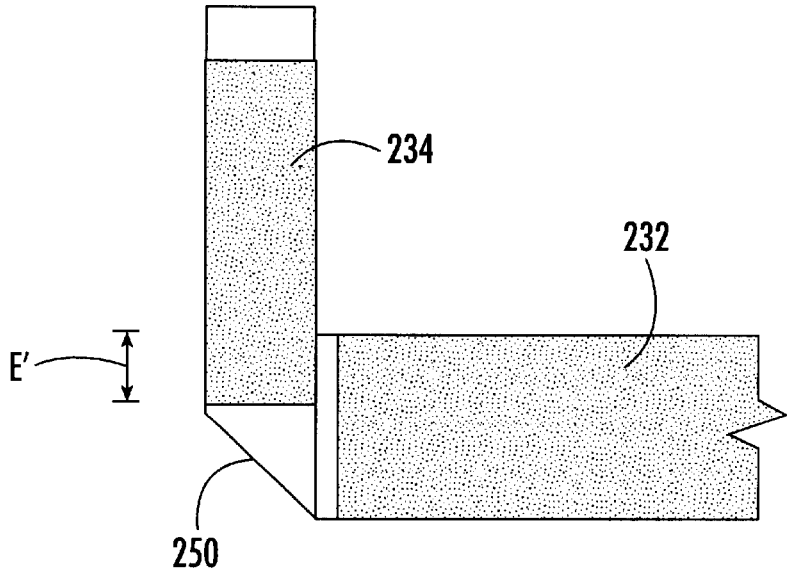
FIG. 2F is a front view of the foil strip of FIG. 2E in the second folded position, and further including insulation covers.
Figure 2A:
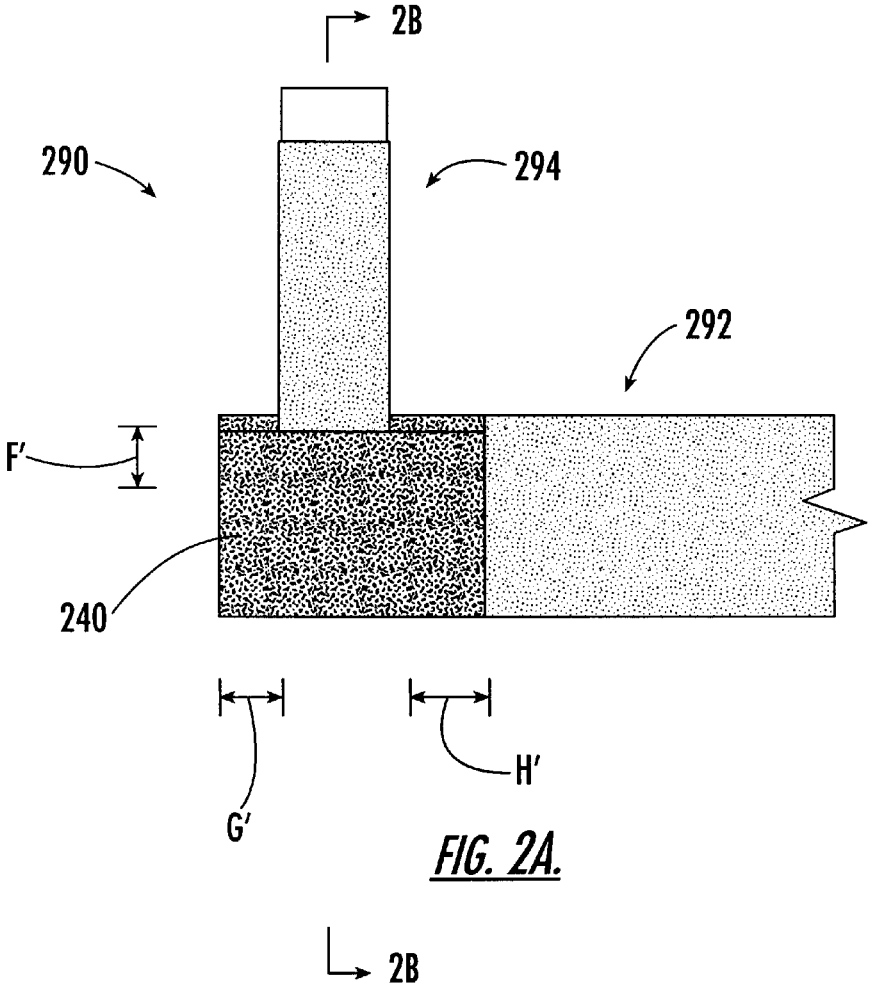
FIG. 2A is a front view of a winding assembly according to a further embodiment of the present invention.
Figure 2B:
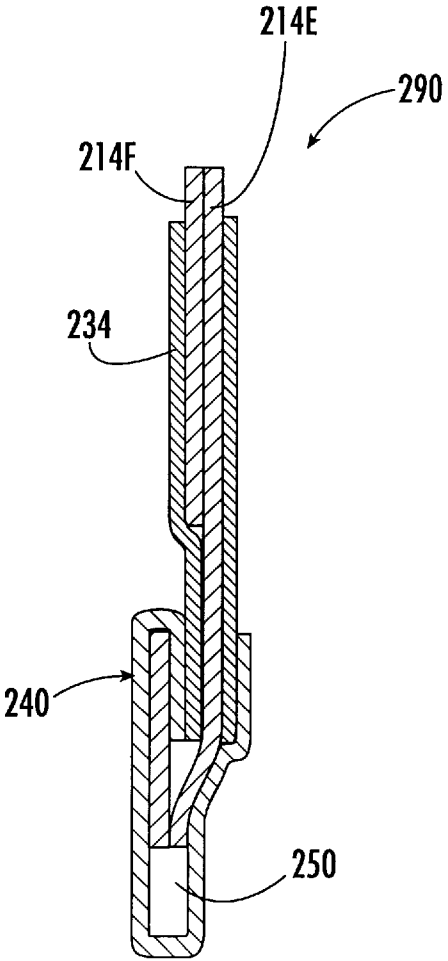
FIG. 2B is a cross-sectional view of the winding assembly of FIG. 2A taken along the line 2B—2B of FIG. 2A.

With reference to FIGS. 2A and 2B, a winding assembly 290 according to a further embodiment of the present invention is shown therein. The winding assembly 290 includes a winding portion 292 and a folded breakout 294. The winding assembly 290 may include a second breakout on the end of the winding portion 292 opposite the breakout 294. The construction of the winding assembly 290 may be better appreciated from FIGS. 2A–2G and the description of a method for forming the winding assembly 290 that follows.

Figure 2G:
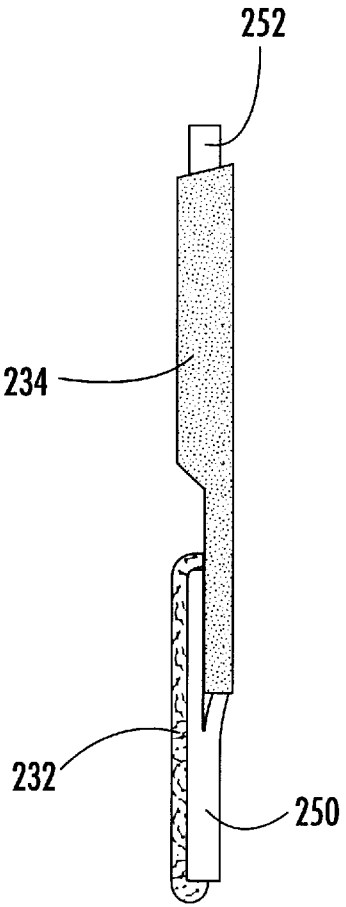
FIG. 2G is a left end view of the foil strip and insulation covers of FIG. 2F.
Figure 2C:
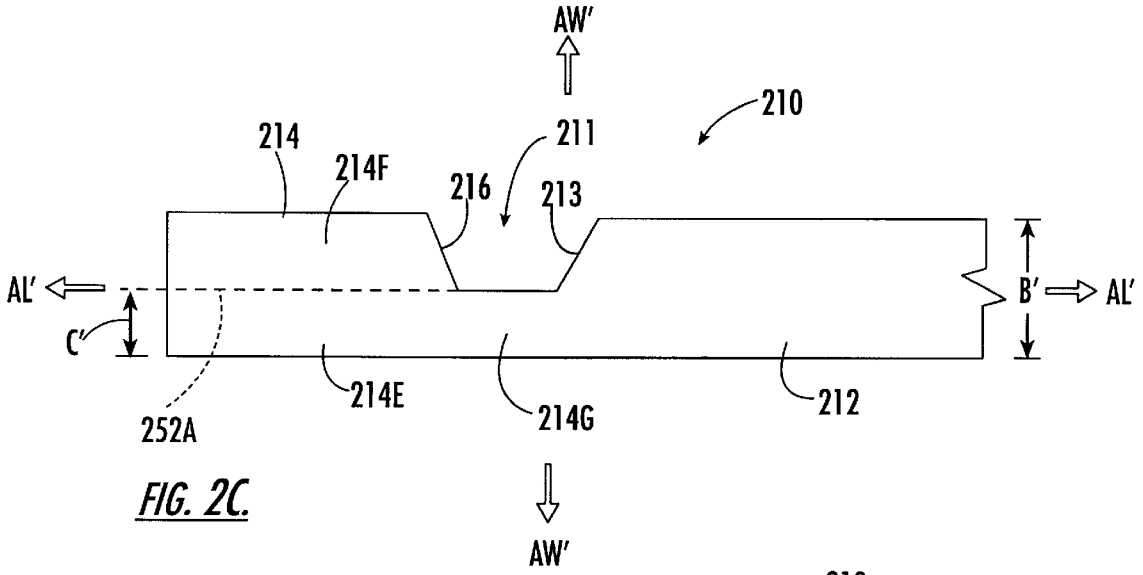
FIG. 2C is a front view of a foil strip for forming the winding assembly of FIG. 2A.

With reference to FIG. 2C, a foil strip 210 is provided. The foil strip 210 is the same as the foil strip 110 except that the strip 210 is shaped differently. The strip 210 has a lengthwise axis AL'—AL' and a widthwise axis AW'—AW' perpendicular thereto. The strip 210 includes a winding portion 212 and a breakout portion 214. Preferably, the winding portion 212 and the breakout portion 214 have the same width B'. The breakout portion 214 includes a lower section or panel 214E, an upper section or panel 214F, and a connecting section 214G connecting the lower panel 214E to the winding portion. Preferably, the panels 214E and 214F have the same width C'. The upper edge of the connecting portion 214G and opposing, sloped edges 213, 216 define a cut-out 211. Preferably, each of the edges 213 and 216 forms an angle of between about 45 and 90 degrees with respect to the lengthwise axis AL'—AL' of the strip 210.

Figure 2D:
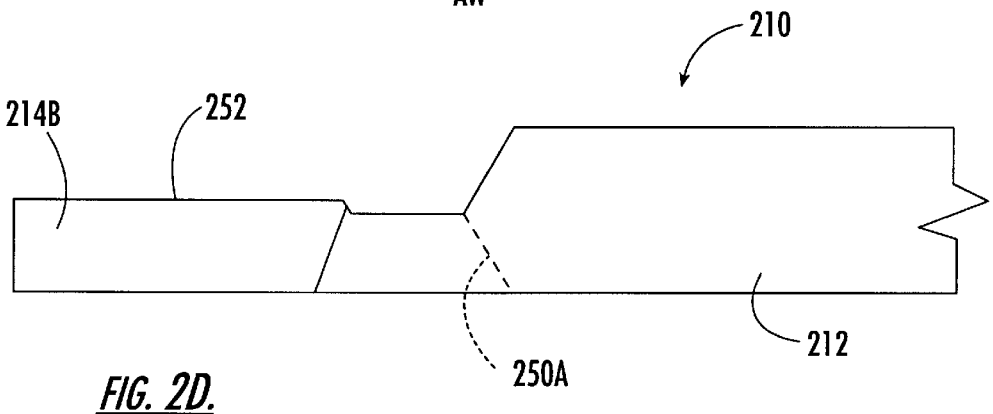
FIG. 2D is a front view of the foil strip of FIG. 2C in a first folded position.
Figure 2E:
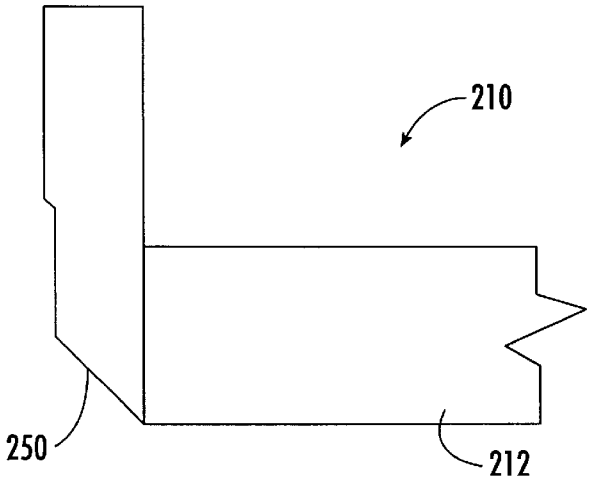
FIG. 2E is a front view of the foil strip of FIG. 2D in a second folded position.

The panel 214F is folded down about a fold line 252A (see FIG. 2C) and onto the panel 214E to form a fold 252 as shown in FIG. 2D. The connecting portion 214G is also folded about a fold line 250A (see FIG. 2D) to form a fold 250 (see FIG. 2E). Preferably, the fold 250 forms an angle of about 45 degrees with respect to each of the axes AL'—AL' and AW'—AW'. Each of the folds 250, 252 may be forcibly flattened and deburred or otherwise finished in the manner described above with regard to the foil strip 110.

Thereafter, insulation covers 232 and 234 corresponding to the insulation covers 132 and 134, respectively, are wrapped about the strip 210 in the manner described above with regard to the winding assembly 190 and as shown in FIGS. 2F and 2G. However, in the case of the strip 210, the insulation cover 234 is wrapped around both of the superimposed foil panels 214E, 214F.

A supplemental insulation cover 240 corresponding to the supplemental insulation cover 140 is wrapped about the folded strip 210 and the covers 232, 234 in the same manner as described above with regard to the insulation cover 140 and as shown in FIGS. 2A and 2B. The cross-sectional views of FIGS. 1C and 1D likewise illustrate the configuration of the winding assembly 290 at corresponding cross-section locations.

The dimensions B', E', F', G', H' and I' correspond to the dimensions B, E, F, G, H and I, respectively, of the winding assembly 190. Preferably, each of the distances B', C', E', F', G', H' and I' is equal to or greater than the required or desired creepage distance and clearance.

For some applications, the winding assembly 290 may be preferred over the winding assembly 190 because, except for the connecting portion 214G, the breakout 294 has the same conductor area as the winding portion 292. As a result, the total winding resistance of the winding assembly 290 may be reduced as compared to that of the winding assembly 190.

Figure 3D:
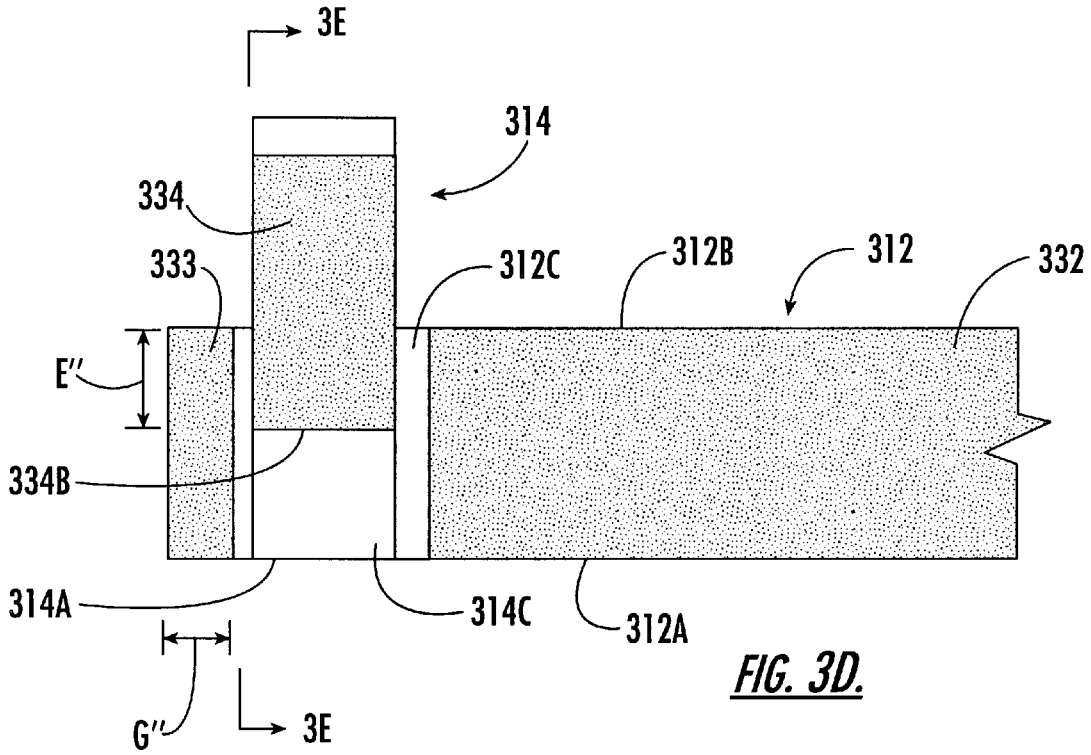
FIG. 3D is a front view of the winding strip and the breakout strip of FIG. 3C in a joined position.
Figure 3A:
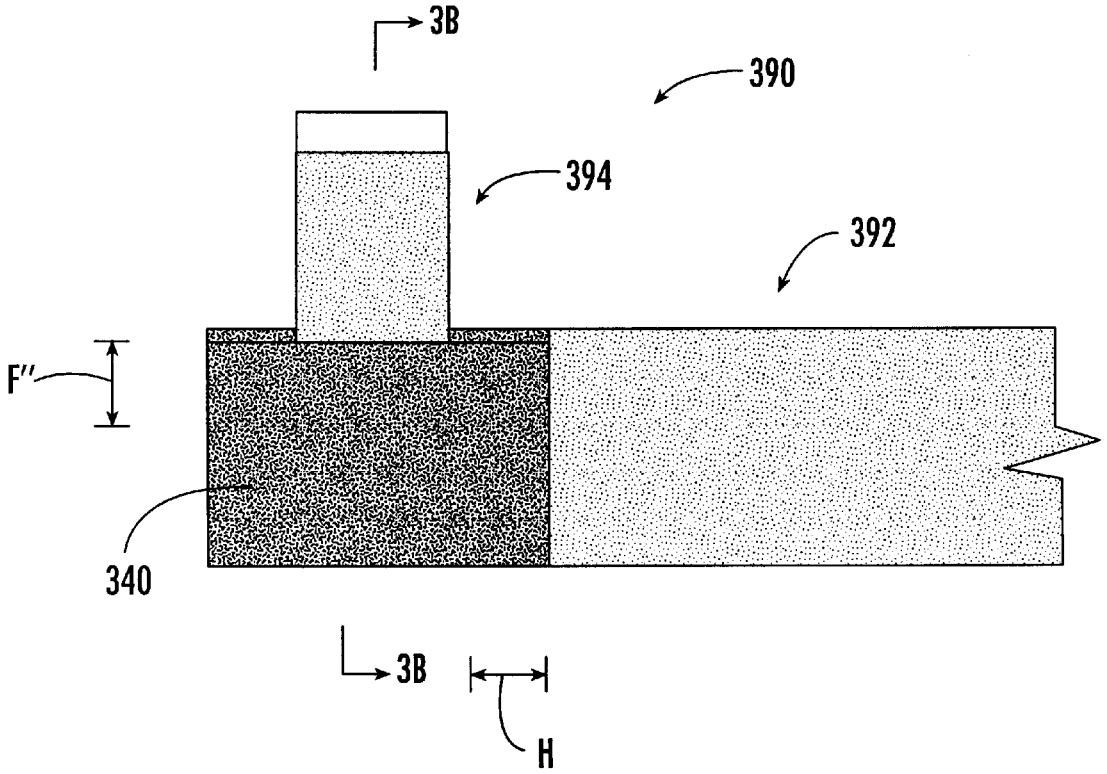
FIG. 3A is a front view of a winding assembly according to a further embodiment of the present invention.
Figure 3B:
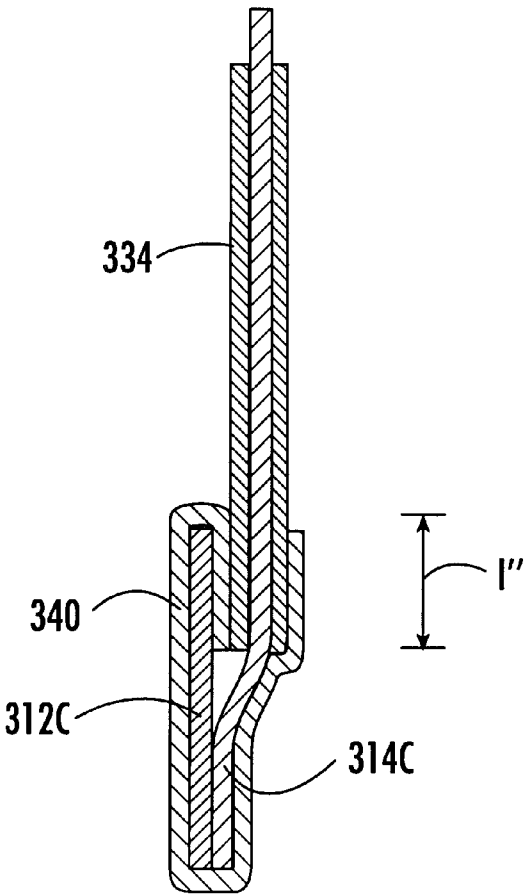
FIG. 3B is a cross-sectional view of the winding assembly of FIG. 3A taken along the line 3B—3B of FIG. 3A.

With reference to FIGS. 3A and 3B, a winding assembly 390 according to a further embodiment of the present invention is shown therein. The winding assembly 390 includes a winding portion 392 and a joined breakout 394. The winding assembly 390 may include a second breakout on the end of the winding portion 392 opposite the breakout 394. The breakout 394 may be relocated to a more central position along the winding portion to serve as a breakout tap. The construction of the winding assembly 390 may be better appreciated from FIGS. 3A–3E and the description of a method for forming the winding assembly 390 that follows.

Figure 3E:
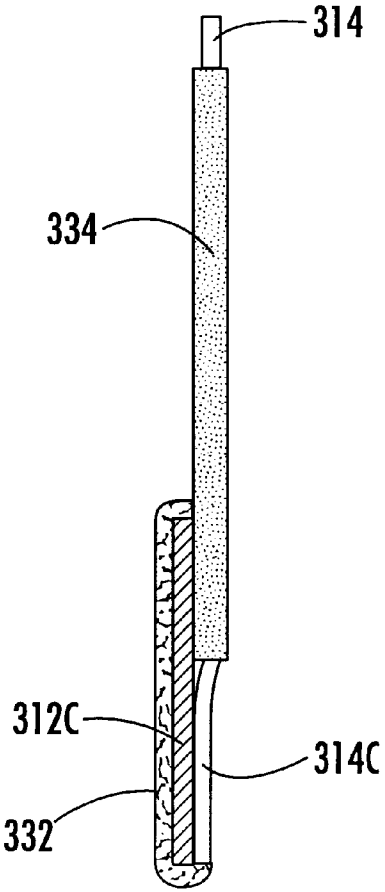
FIG. 3E is a cross-sectional view of the winding strip and breakout strip of FIG. 3D taken along the line 3E—3E of FIG. 3D.
Figure 3C:
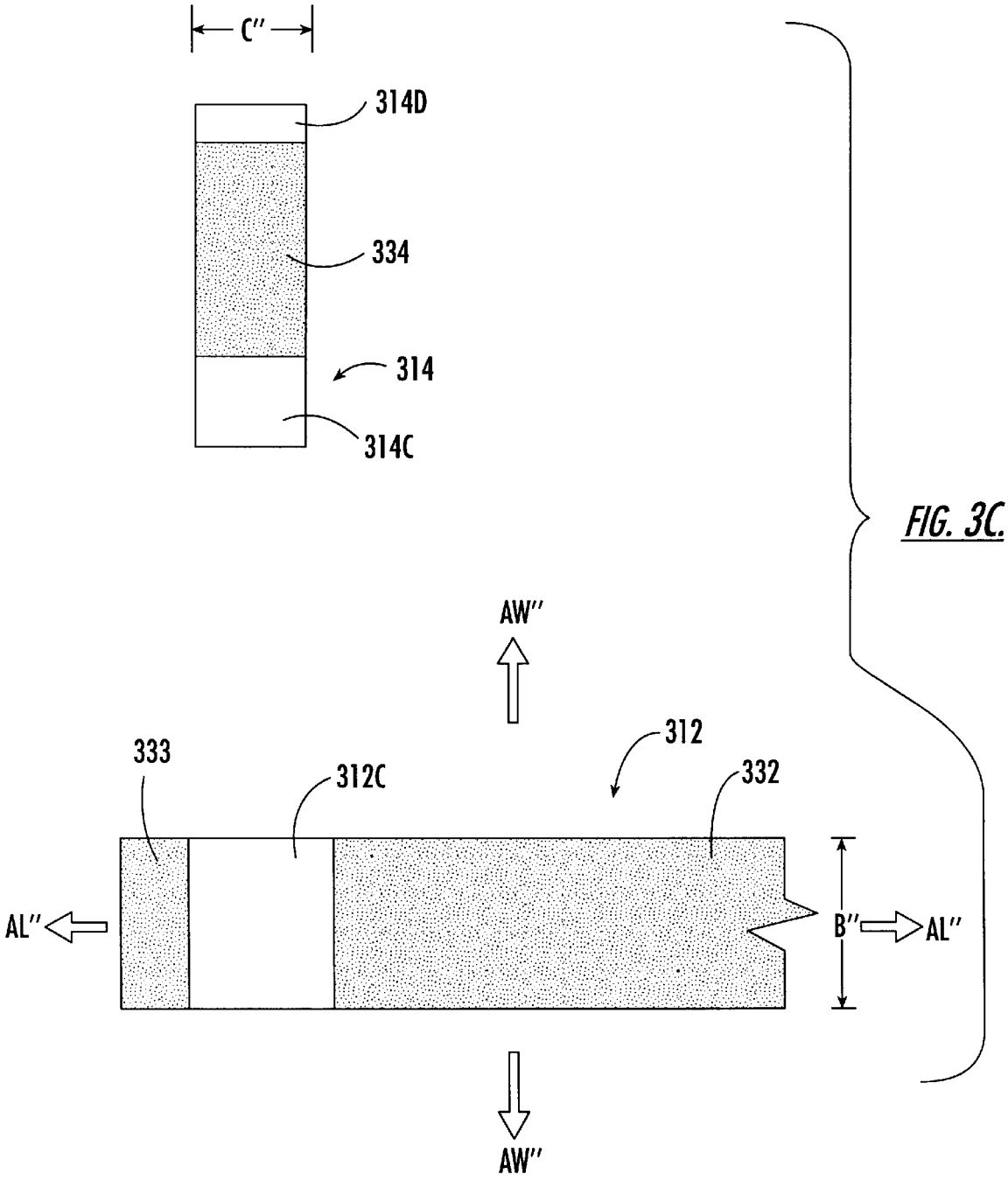
FIG. 3C is an exploded view of a winding strip and a breakout strip for forming the winding assembly of FIG. 3A.

With reference to FIG. 3C, a winding strip 312 and a discrete, separately formed breakout strip 314 are provided. The strips 312 and 314 are each formed of the same material as described above with regard to the foil strip 110. The breakout strip 314 has a width C" preferably of the same relative dimensions as described above with regard to the width C of FIG. 1E. The winding strip 312 has a lengthwise axis AL"—AL" and a perpendicular widthwise axis AW"—AW". The winding strip 312 has a width B" preferably of the same relative dimensions as the width B of FIG. 1E.

An insulation cover 334 is wrapped fully around the breakout strip 314. The insulation cover 334 is sized and configured such that an upper, exposed portion 314D of the breakout strip 314 extends above the insulation cover 334 and a lower, exposed portion 314C of the breakout strip 314 extends below the insulation cover 334. The insulation cover 334 is preferably formed of the materials and secured in the manner described above with regard to the insulation cover 134.

An insulation cover 332 and an insulation cover 333 each fully surround the winding strip 312 such that an exposed, intermediate portion 312C of the winding strip 312 is positioned between the insulation covers 332 and 333 along the axis AL"—AL". The insulation covers 332 and 333 are preferably formed of the same materials and secured in the same manner as the insulation cover 132.

With reference to FIGS. 3D and 3E, the breakout strip 314 is positioned against the winding strip 312 such that the portion 314C contacts the portion 312C and a lower portion of the insulation cover 334 overlaps the portion 312C a distance E". Preferably, the lower edge 314A of the breakout strip 314 is aligned with the lower edge 312A of the winding strip 312 as shown. The portion 314C of the breakout strip 314 is positioned fully between the adjacent edges of the insulation covers 332 and 333.

Thereafter, a supplemental insulation cover 340 corresponding to the supplemental insulation cover 140 is wrapped around and between the winding strip 312 and the breakout strip 314 as shown in FIGS. 3A and 3B and in the manner described above with respect to the supplemental insulation cover 140. The cross-sectional views of FIGS. 1C and 1D likewise illustrate the configuration of the winding assembly 390 at corresponding cross-section locations.

The dimensions B", C", E", F", G", H" and I" correspond to the dimensions B, C, E, F, G, H and I, respectively, of the winding assembly 190. Preferably, each of the distances B", C", E", F", G", H" and I" is equal to or greater than the required or desired creepage distance and clearance.

Figure 4A:
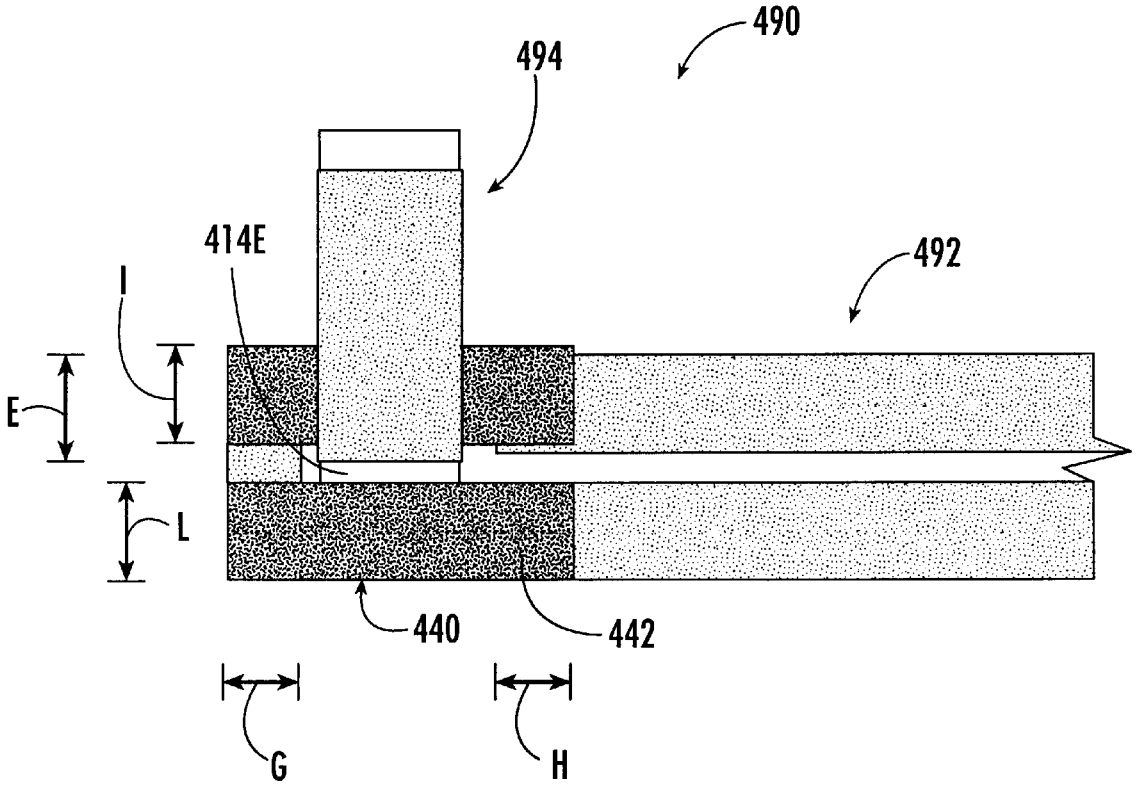
FIG. 4A is a front view of a winding assembly according to a further embodiment of the present invention.
Figure 4B:
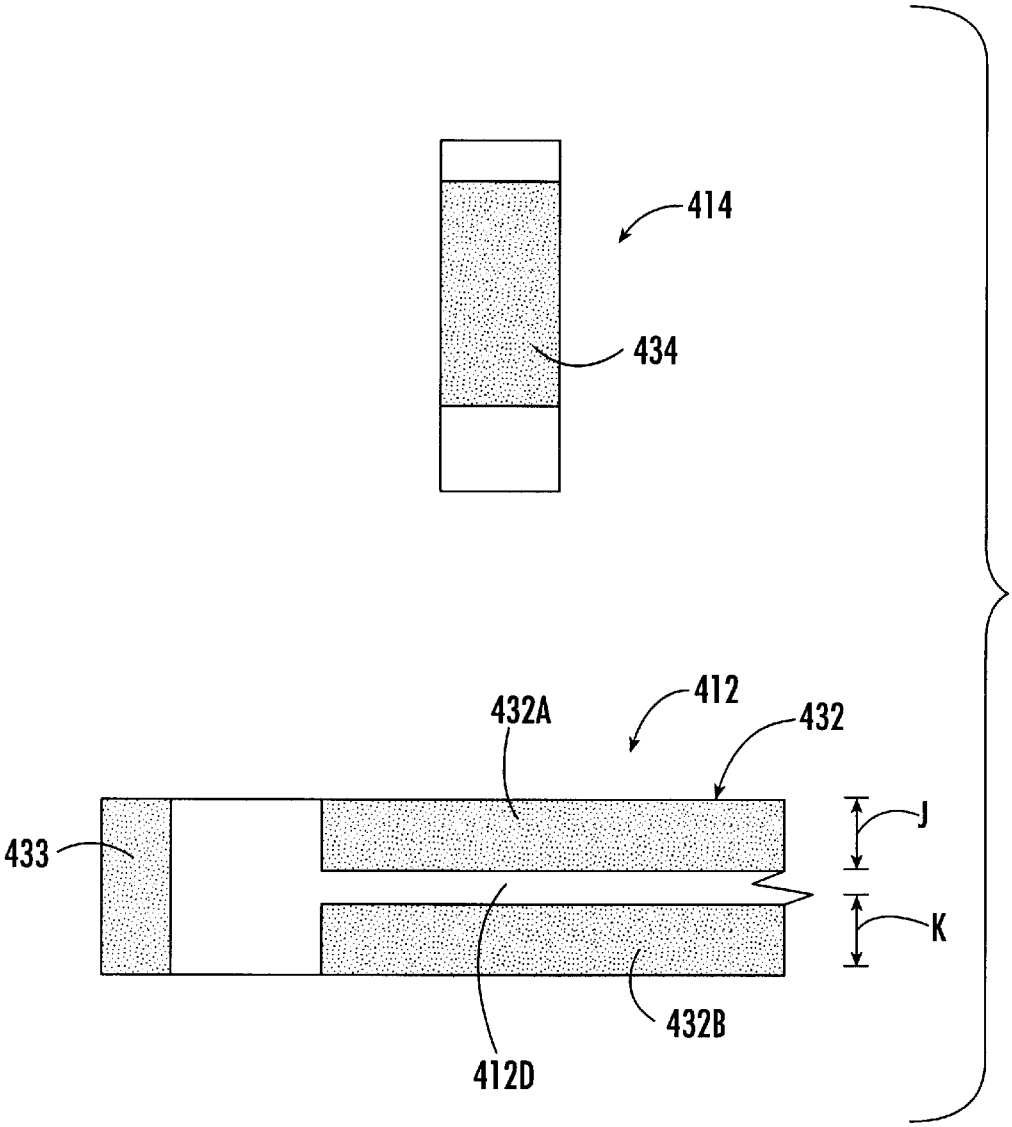
FIG. 4B is an exploded view of a winding strip and a breakout strip for forming the winding assembly of FIG. 4A.
Figure 5:
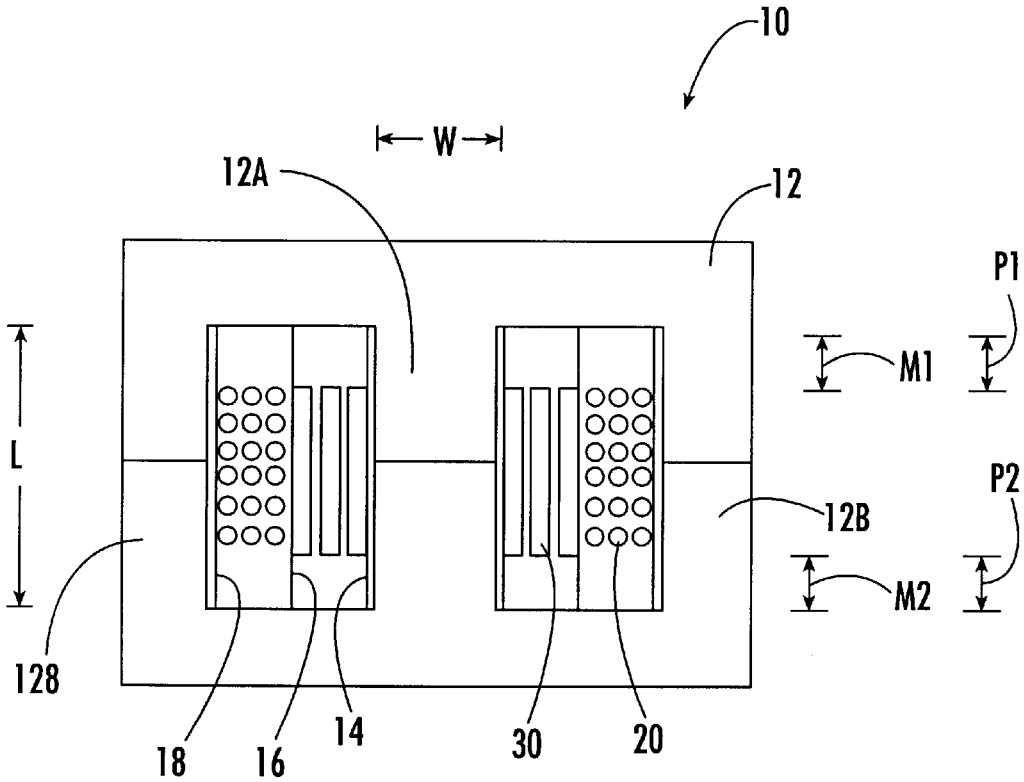
FIG. 5 is a schematic, cross-sectional view of a margin coil design transformer.

With reference to FIG. 4A, a winding assembly 490 according to a further embodiment of the present invention is shown therein. The winding assembly 490 includes a winding portion 492 and a joined breakout 494. The winding assembly 490 may include a second breakout on the end of the winding portion 492 opposite the breakout 494. The construction of the winding assembly 490 may be better appreciated from FIGS. 4A and 4B and the description of a method for forming the winding assembly 490 that follows.

A winding strip 412 and a breakout strip 414 are provided. The breakout strip 414 is the same as the breakout strip 314 and has an insulation cover 434 corresponding to the insulation cover 334 wrapped thereabout and secured thereto. The winding strip 412 is the same as the winding strip 312 and has insulation covers 432 and 433 wrapped thereabout and secured thereto. The insulation cover 433 corresponds to the insulation cover 333.

The insulation cover 432 corresponds to the insulation cover 332 except as follows. The insulation cover 432 has opposed cuffs 432A and 432B which define an intermediate, lengthwise extending exposed portion 412D of the winding strip 412 therebetween. Preferably, the insulation cover 432 fully covers the reverse side of the winding strip 412. Alternatively, an opening may be provided in the insulation cover 432 on the reverse side as well whereby an exposed portion corresponding to the exposed portion 412D is present on the reverse side of the winding strip 412.

The breakout strip 414 is mounted on the winding strip 412 in the same manner as described above for mounting the breakout strip 314 on the winding strip 312. A supplemental insulation cover 440 is wrapped about the winding strip 412 and the breakout strip 414 in the same manner as described above with regard to the supplemental insulation cover 340. The insulation cover 440 differs from the insulation cover 340 in that the lower, front panel 442 of the insulation cover 440 is abbreviated so that a portion 414E of the breakout strip 414 remains exposed. For this reason, it may be necessary to provide one or more additional insulation layers to provide the stipulated clearance and distance through insulation to the next winding.

The dimensions E"', G"', H"' and I"' correspond to the dimensions E, G, H and I, respectively, of the winding assembly 190. Preferably, each of the distances E"', G"', H"' and I"', as well as the distance J (the width of the cuff 432A), the distance K (the width of the cuff 432B), and the distance L (the width of the panel 442) are equal to or greater than the required or desired creepage distance and clearance.

Optionally, the portions of the winding strips 312, 412 extending leftwardly beyond the breakout strips 314, 414 may be reduced (e.g., to only a few millimeters) and the insulation covers 333, 433 omitted. In this case, the supplemental insulation covers 340, 440 should extend leftwardly beyond the leftmost edges of the winding strips 312, 412 a distance corresponding to the distance G (FIG. 1A) discussed above with regard to the winding assembly 190.

With reference to FIG. 10, a winding assembly 590 according to a further embodiment of the present invention is shown therein. The winding assembly 590 includes a winding portion 592 and a joined breakout 594. The winding assembly 590 may include a second breakout on the end of the winding portion 592 opposite the breakout 594. The construction of the winding assembly may be better appreciated from FIGS. 10A to 10D and the description of a method for forming the winding assembly 590 that follows.

Figure 10C:
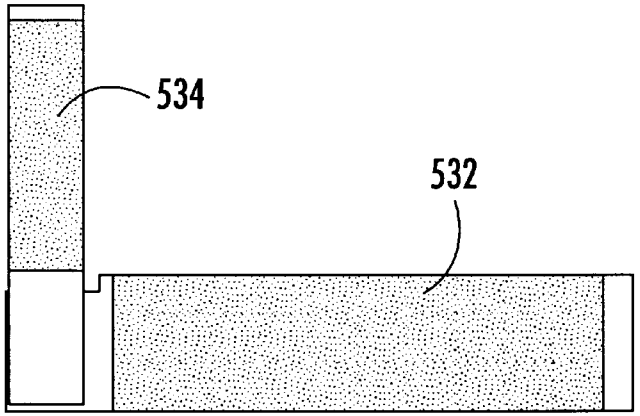
FIG. 10C is a front view of the winding strip and breakout strip of FIG. 10B with insulation covers mounted thereon.
Figure 10A:
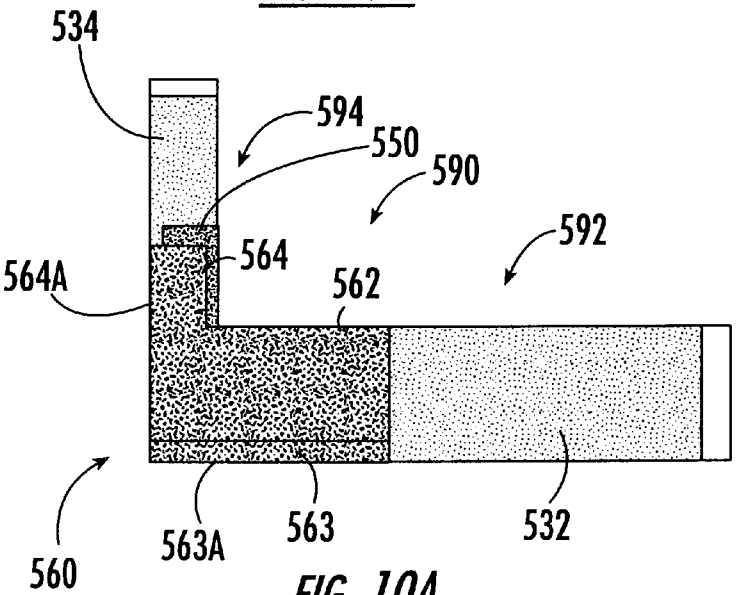
FIG. 10A is a front view of a winding assembly according to a further embodiment of the present invention.
Figure 10B:
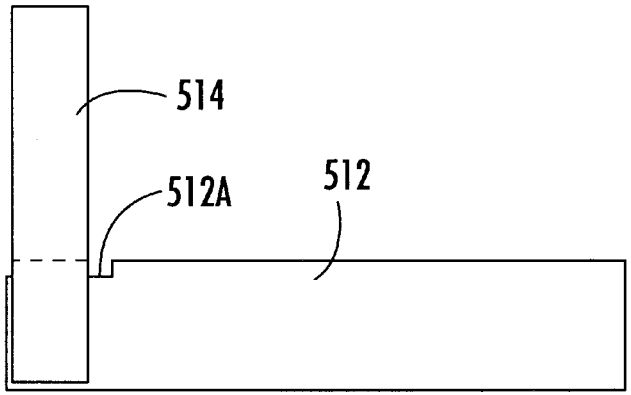
FIG. 10B is a front view of a winding strip and a breakout strip for forming the winding assembly of FIG. 10A in a joined position.

A winding strip 512 and a breakout strip 514 are provided and relatively positioned as shown in FIG. 10B. The breakout strip 514 is the same as the breakout strip 314. The winding strip 512 is the same as the winding strip 312 except that a notch 512A is provided adjacent the breakout strip 514. Prior to or following the step of positioning the breakout strip 514 on the winding strip 512, an insulation cover 534 corresponding to the insulation cover 334 is wrapped about and secured to the breakout strip 514. Similarly, prior to or following the step of positioning the breakout strip 514, an insulation cover 532 corresponding to the insulation cover 332 is wrapped about and secured to the winding strip 512. Notably, it is not necessary to overlap the insulation cover 534 with the winding strip 512.

Figure 10D:
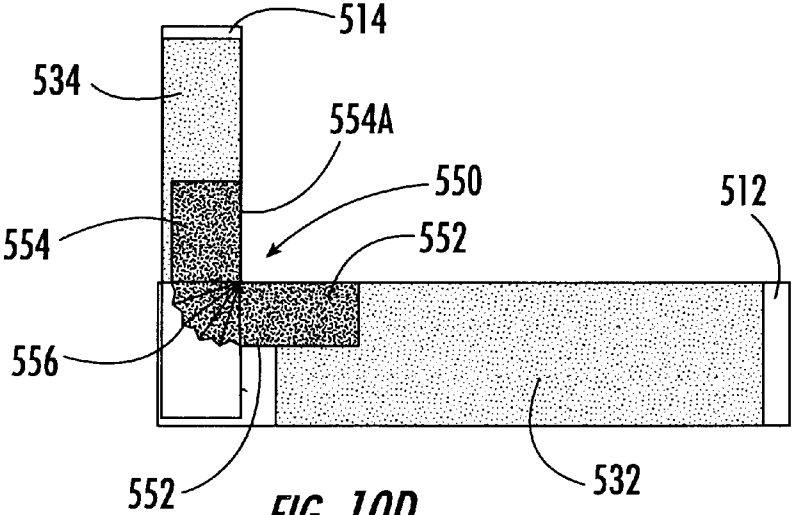
FIG. 10D is a front view of the winding strip, breakout strip, and insulation covers of FIG. 10C with a bellows cover mounted thereon.

Thereafter, a bellows cover 550 is placed in the inner corner between the breakout strip 514 and the winding strip 512 as shown in FIG. 10D. The bellows cover includes opposed leg portions 554 on either side of the breakout strip 514 and joined along an edge fold 554A. The bellows cover 550 also includes opposed leg portions 552 disposed on either side of the winding strip 512 and joined along an edge fold 552A. Opposed bellows sections 556 join the leg portions 554 and 552 on either side of the strips 512, 514. The leg portions 552 and 554 overlap the insulation covers 532 and 534, respectively.

With reference to FIG. 10A an L-shaped cover 560 is applied over the breakout strip 514 and the winding strip 512 as shown. The L-shaped cover 560 includes opposed leg portions 564 disposed on opposed sides of the breakout strip 534 and joined along a fold 564A. The L-shaped cover 560 also includes opposed leg portions 562. One or both of the leg portions 562 are folded back to form panels 563 which are joined to the leg portions 562 along a fold 563A. The fold 563A intersects the fold 564A to insure that no gap is presented along the rightward and lower edges of the L-shaped cover 560. The leg portions 564 overlap the leg portions 554 and a portion of each of the bellows sections 556. The leg portions 552 overlap the insulation cover 534, the leg portions 554, and portions of each of the bellows sections 556. The leg portions 562 overlap the insulation cover 532, the leg portions 552, and portions of each of the bellows sections 556.

The bellows cover 550 and the L-shaped cover 560 may each be formed of any suitable insulating material. For example, the bellows cover 550 and the L-shaped cover 560 may be formed of the materials discussed above with regard to the insulation covers 132 and 134.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A method for forming an insulated winding assembly for an electrical transformer, said method comprising the steps of:

providing an integral foil strip having a lengthwise axis, the foil strip including a winding portion and a breakout portion extending from the winding portion along the lengthwise axis;

folding the breakout portion about the winding portion to form a fold between the breakout portion and the winding portion; and thereafter, securing an insulation cover to the foil strip.

2. The method of claim 1 wherein said step of securing an insulation cover to the foil strip includes securing a first insulation cover to the winding portion and securing a second insulation cover to the breakout portion such that a contact portion of the foil strip adjacent the fold remains exposed, and further including the step of securing a supplemental insulation cover over the contact portion.

3. The method of claim 2 including overlapping the second insulation cover over the winding portion by at least a prescribed minimum creepage distance.

4. The method of claim 2 wherein said step of securing a supplemental insulation cover over the contact portion includes wrapping the supplemental insulation cover about and between the winding portion and the breakout portion such that the supplemental insulation cover includes a first panel covering the breakout portion, a second panel covering a rear surface of the winding portion, and a third panel disposed between the winding portion and the breakout portion.

5. The method of claim 4 including:

overlapping the second insulation cover over the winding portion by at least a prescribed minimum creepage distance;

overlapping the first panel of the supplemental insulation cover over the second insulation cover by at least the prescribed minimum creepage distance; and overlapping the third panel of the supplemental insulation cover over the winding portion and between the winding portion and the breakout portion by at least the prescribed minimum creepage distance.

6. The method of claim 5 wherein the supplemental insulation cover has marginal portions disposed on opposed sides of the breakout portion along the lengthwise axis.

7. The method of claim 6 wherein the marginal portions each extend beyond the breakout portion along the lengthwise axis at least the prescribed minimum creepage distance.

8. The method of claim 1 wherein the breakout portion is narrower than the winding portion.

9. The method of claim 1 wherein the foil strip has a widthwise axis perpendicular to the lengthwise axis and further including the step of folding the breakout portion to form a second fold and first and second superimposed breakout portion panels joined along the second fold, the second fold extending at an angle relative to the widthwise axis, and wherein the step of securing an insulation cover includes wrapping the insulation cover about the first and second breakout portion panels.

10. The method of claim 9 wherein the foil strip includes a connecting portion between the winding portion and the breakout portion, the connecting portion being narrower than each of the winding portion and the breakout portion.

11. The method of claim 10 wherein the winding portion and the breakout portion have substantially the same width.

12. The method of claim 1 wherein said step of folding the breakout portion includes forming the fold such that the fold extends at an angle relative to the lengthwise axis.

13. A method for forming an insulated winding assembly for an electrical transformer, said method comprising the steps of:

providing a foil winding portion and a foil breakout portion adjoining the winding portion, the breakout portion overlapping and extending at an angle with respect to the winding portion; and wrapping a supplemental insulation cover about and between the winding portion and the breakout portion such that the supplemental insulation cover includes a first panel covering the breakout portion, a second panel covering a rear surface of the winding portion, and a third panel disposed between the winding portion and the breakout portion.

14. The method of claim 13 wherein the winding portion and the breakout portion are formed from a unitary foil strip.

15. The method of claim 13 wherein the winding portion and the breakout portion are separately formed foil strips.

16. A winding assembly for use in a transformer, said winding assembly comprising:

a) a foil strip including:

a winding portion; and a breakout portion integral with said winding portion and joined to said winding portion along a fold;

b) a first insulation cover covering a portion of said winding portion;

c) a second insulation cover covering a portion of said breakout portion; and d) a supplemental insulation cover covering each of said winding portion and said breakout portion.

17. The winding assembly of claim 16 wherein said supplemental insulation cover covers a contact portion of said foil strip that is not covered by either of said first and second insulation covers.

18. The winding assembly of claim 16 wherein said second insulation cover overlaps said winding portion by at least a prescribed minimum creepage distance.

19. The winding assembly of claim 16 wherein said supplemental insulation cover includes a first panel covering said breakout portion, a second panel covering a rear surface of said winding portion, and a third panel disposed between said winding portion and said breakout portion.

20. The winding assembly of claim 19 wherein:

said second insulation cover overlaps said winding portion by at least a prescribed minimum creepage distance;

said first panel of said supplemental insulation cover overlaps said second insulation cover by at least said prescribed minimum creepage distance; and said third panel of said supplemental insulation cover overlaps said winding portion and between said winding portion and said breakout portion by at least said prescribed minimum creepage distance.

21. The winding assembly of claim 16 wherein said winding portion has a lengthwise axis and said supplemental insulation cover has marginal portions disposed on opposed sides of said breakout portion along said lengthwise axis.

22. The winding assembly of claim 21 wherein said marginal portions each extend beyond said breakout portion along said lengthwise axis at least said prescribed minimum creepage distance.

23. The winding assembly claim 16 wherein said breakout portion is narrower than said winding portion.

24. The winding assembly of claim 16 wherein:

said breakout includes first and second superimposed breakout portion panels joined along a second fold; and said second insulation cover is wrapped about said first and second breakout portion panels.

25. The winding assembly of claim 16 wherein said winding portion has a lengthwise axis and said fold extends at an angle relative to said lengthwise axis.

26. A winding assembly for use in an electrical transformer, said winding assembly comprising:

a) a foil winding portion;

b) a foil breakout portion adjoining said winding portion, said breakout portion overlapping and extending at an angle with respect to said winding portion; and c) a supplemental insulation cover wrapped about and between said winding portion and said breakout portion, said supplemental insulation cover including a first panel covering said breakout portion, a second panel covering a rear surface of said winding portion, and a third panel disposed between said winding portion and said breakout portion.

27. The winding assembly of claim 26 wherein said winding portion and said breakout portion are formed from a unitary foil strip.

28. The winding assembly of claim 26 wherein said winding portion and said breakout portion are separately formed foil strips.

* * * * *